United States Patent [19]

Amos et al.

[11] Patent Number: 5,031,546

[45] Date of Patent: Jul. 16, 1991

[54] HOPPER CAR DISCHARGE SYSTEM

[75] Inventors: Edward H. Amos, Richwood; David Mata, Brazoria; Pedro C. Longoria, Angleton, all of Tex.

[73] Assignee: The Dow Chemical Company, Midland, Mich.

[21] Appl. No.: 317,164

[22] Filed: Feb. 28, 1989

[51] Int. Cl.[5] ..... B61D 7/32

[52] U.S. Cl. ..... 105/248; 239/683; 366/304; 366/307; 222/238

[58] Field of Search ..... 222/237, 238; 239/683, 239/669, 675, 689; 105/234, 247, 248; 406/135; 366/302, 303, 304, 307

[56] References Cited

U.S. PATENT DOCUMENTS

| | | | |
|---|---|---|---|
| 000,567 | 1/1838 | Duvall | 366/303 |
| 621,203 | 3/1899 | Ballbach | 366/303 X |
| 1,712,235 | 5/1929 | Small | 105/247 |
| 1,889,562 | 11/1932 | Moulthrop . | |
| 1,980,895 | 11/1934 | Windecker | 106/271 |
| 2,669,271 | 2/1954 | Treckmann | 239/669 X |
| 2,872,080 | 2/1959 | Thene | 222/238 X |
| 2,877,938 | 3/1969 | Cox | 222/502 |
| 2,910,250 | 10/1959 | Fisher | 222/238 |
| 3,174,807 | 3/1965 | Adler | 302/52 |
| 3,246,805 | 4/1966 | Kemp | 222/195 |
| 3,831,803 | 8/1974 | Hutchison et al. | 220/46 R |
| 3,901,419 | 8/1975 | Szendroi | 222/506 |
| 4,388,026 | 6/1983 | Green | 406/130 |
| 4,459,070 | 7/1984 | Bourgeois | 406/90 |
| 4,617,868 | 10/1986 | Wahlstrom et al. | 105/282 A |
| 4,628,825 | 12/1986 | Taylor et al. | 105/289 |
| 4,706,854 | 11/1987 | Pole | 222/459 |
| 4,766,820 | 8/1988 | Ritter et al. | 105/240 |
| 4,778,276 | 10/1988 | Meyer et al. | 366/303 X |

FOREIGN PATENT DOCUMENTS

| | | |
|---|---|---|
| 3532722 | 3/1987 | Fed. Rep. of Germany . |

*Primary Examiner*—Andres Kashnikow
*Assistant Examiner*—William Grant
*Attorney, Agent, or Firm*—W. J. Lee

[57] ABSTRACT

A hopper discharge outlet unit for railroad hopper cars useful for breaking up large chunks of agglomerated material and permits continuous off-loading of the railroad hopper cars including a delumper mounted inside of a pneumatic hopper discharge outlet housing in conjunction with standard pneumatic hoses and an external detachable motor. The apparatus prevents large chunks of material from plugging the pneumatic outlets.

2 Claims, 3 Drawing Sheets

HOPPER CAR DISCHARGE SYSTEM

BACKGROUND OF THE INVENTION

This invention relates to a railroad hopper car for shipment of a solid granular commodity and more particularly to a railroad hopper car having an effective hopper discharge outlet system for emptying a solid commodity from the railroad hopper car.

A common type of railroad freight car used today is the covered freight car of the type wherein a load is discharged through a discharge outlet on the underside of the body of the car. This type of railroad car, known also as a railroad hopper car, is commonly used to haul dry granular solids of various particle sizes such as grain, phosphates, plastics, and other dry bulk commodities that require protection from the natural elements.

It is well known in the prior art to provide for pneumatic discharge arrangements for hoppers of railroad cars, for example, as described in U.S. Pat. No. 3,246,805 and for example, a pneumatic discharge assembly in combination with a sliding gate or valve member as described in U.S. Pat. No. 4,388,026. The discharge hoppers located at the underside of the railroad cars are known to operate by pneumatic hoses connected to outlets positioned at two sides of a hopper compartment and an external detachable motor.

One problem encountered with such conventional pneumatic conveying systems is the tendency of product particulate material to form agglomerates and then the agglomerated product readily obstructing the discharge outlets. The problem of plugging of pneumatic outlets in the hopper compartments by agglomerated product is a serious problem particularly in the chemical industry.

During the discharge of the hopper cars, large chunks of the agglomerated product falls down to the hopper and "blinds off" the pneumatic outlets so that continuous off loading can not take place. "Bridging" of the material is also a problem. Agglomeration of product material may be caused by many factors including moisture, heat, time, the action caused by the weight of the material and compaction of the material during charging and moving of the railroad hopper car.

It is the aforementioned plugging problems that is desired to be solved.

SUMMARY OF THE INVENTION

It is a general object of the present invention to provide a hopper construction for railroad cars useful for effective discharge of solid particulate material and unloading railroad hopper cars.

One aspect of the present invention is directed to a hopper outlet for discharging a solid commodity including:

a. means defining a sloping surface that terminates adjacent above a discharge trough;
b. means defining an enclosed elongated trough beneath said side walls;
c. a rotating shaft across said trough attached to end walls;
d. a plurality of stationary blades on side walls; and
e. a plurality of rotating blades on said shafts, whereby the blades break apart any agglomerated solid commodity passing to the hopper outlet.

Another aspect of the present invention is directed to a railroad car comprising an enclosed vessel for a solid commodity and a plurality of hopper outlets at the bottom of said vessel for discharging said commodity, each of said hopper outlets comprising:

a. means defining a sloping surface that terminates adjacent above a discharge trough;
b. means defining an enclosed elongated trough beneath said side walls;
c. a rotating shaft across said trough attached to end walls;
d. a plurality of stationary blades on side walls; and
e. a plurality of rotating blades on said shafts, whereby the blades break apart any agglomerated solid commodity passing to the hopper outlet.

DETAILED DESCRIPTION OF THE PREFERRED EMBODIMENT(S)

Figure 1:
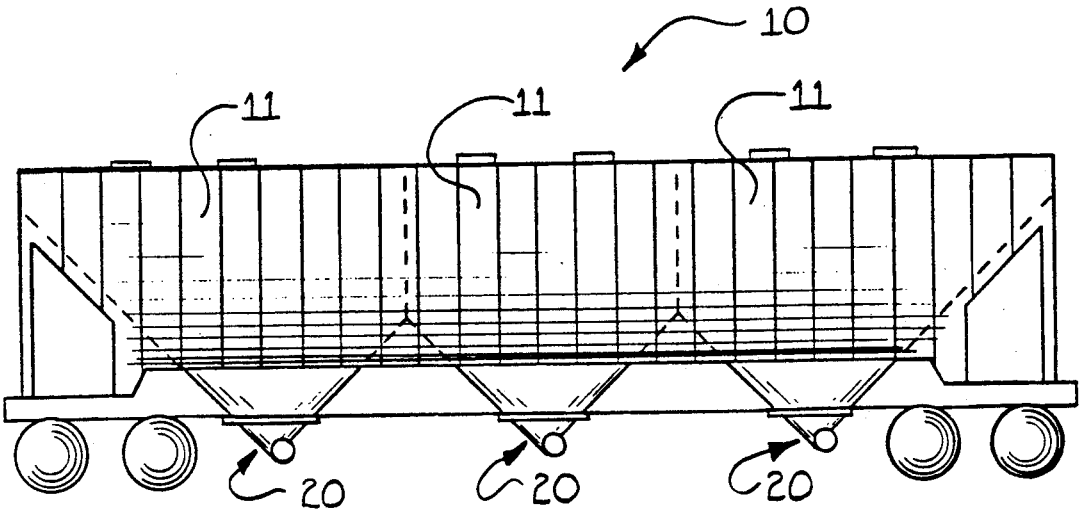
FIG. 1 is a side elevational view showing the present invention installed on a standard three pocket hopper car.

With reference to FIG. 1, there is shown a typical railroad hopper car, generally designated at 10, equipped with a preferred embodiment of the present invention. Car 10 is provided with a plurality of hopper units or structures 11 including a hopper discharge outlet unit of the present invention generally indicated at 20. The hopper discharge outlet unit of the present invention will also be interchangeably referred to herein as a "delumper" or "delumper/off-loader". A material 12 provided in the hopper unit 11 is discharged through the discharge outlet unit 20 to its ultimate point of distribution. A pneumatic conveying system (not shown) is detachably connected to the hopper discharge outlet unit 20 to aid in discharging the material 12 from the car and conveying the material to a use point.

Figure 2:
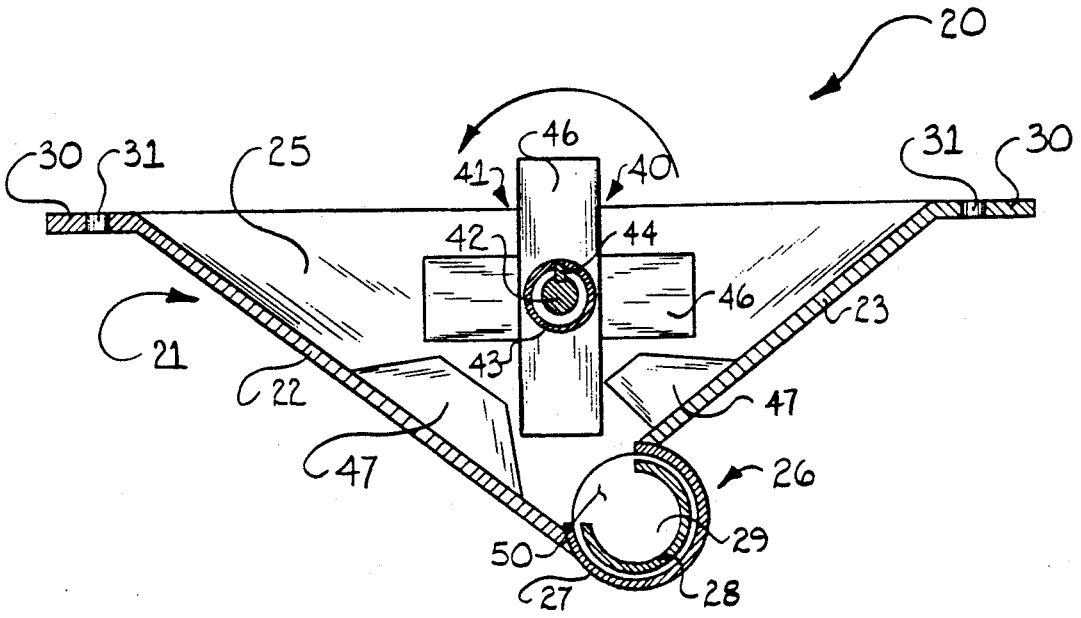
FIG. 2 is a side elevational view, in cross section, showing the delumper of the present invention.

The hopper discharge outlet unit 20 is more clearly shown in FIG. 2. The hopper discharge outlet unit 20 includes a housing 21 which comprises sloping walls 22 and 23 that extend transverse to the direction of travel of the railroad hopper car and constitutes the length of such hopper structure forming the side walls therefor. The discharge outlet unit 20 when viewed in cross section is substantially a V-shaped housing. The angle of slope of walls 22 and 23 should be sufficient to provide a free flowing product to the pneumatic discharge tubular member 28. Generally, the slope of walls 22 and 23 is from about 30 to 60 degrees. A pair of end walls 24 and 25 of the hopper discharge outlet 20 integral with the side walls 22 and 23 forms the hopper enclosure and compartment. The end walls 24 and 25 do not slope but rather extend in a general vertical direction. Integral with the side walls 22 and 23 and end walls 24 and 25 is a discharge arrangement generally indicated as number 26 which forms the bottom of the housing 21.

Figure 3:
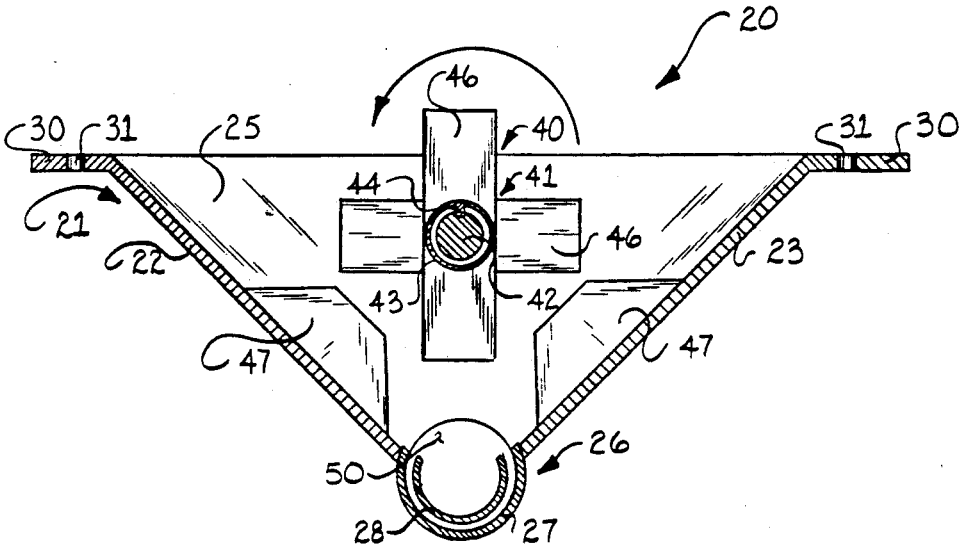
FIG. 3 is a side elevational view, in cross section showing another embodiment of the present invention.

The discharge arrangement 26 includes a housing 27, generally of tubular shape, which is attached to the lower end of the hopper structure 21 and carries coaxially aligned therein a conduit or tubular member 28 with discharge outlets 29 having registered openings cooperating with housing 27 in discharging the contents of the hopper in a known manner. The discharge arrangement 26 may be off-center as shown in FIG. 2 or may be centered as shown in FIG. 3. The off-center arrangement 26 shown in FIG. 2 has been used to retrofit existing hopper cars because such off-center arrangements 26 have the necessary clearance above railroad tracks. The off-center arrangement allows for a steeper slope for walls 22 and 23. Other known mechanisms for discharging the contents of the hopper, such as slide gates, may be used.

The hopper structure 20 is provided with a rectangular shaped horizontally extending and peripherally extending flange structure 30. The flange 30 extends outwardly of the side walls 22 and 23 and end walls 24 and 25 of the housing 21. The flange 30 contains holes 31 for receiving bolts to bolt the hopper discharge outlet unit 20 to the railroad car 10.

A delumper mechanism generally indicated as 40 is removably attached to the end walls 24 and 25 of the hopper 20 and generally is disposed within the compartment of hopper discharge outlet unit 20 of the present invention. The delumper 40 includes a shaft 41 transversed horizontally across the hopper discharge outlet 20 structure and rotatably mounted to the end walls 24 and 25. The shaft 41 comprises an inner shaft member 42 coaxially aligned within the outer tubular shaft member 43. The two shafts 42 and 43 are secured together for rotation by known means such as a key member 44. The double shafts 42 and 43 are used for ease of assembling and disassembling the components of the delumper mechanism. The shaft 41 is retained in position by bearing 45 which also permits the shaft to rotate.

On the outer tubular shaft 43 of the shaft 41 is mounted a plurality of blades 46 which rotate when the shaft is rotated. The blades 46 are used to break up and reduce the size of agglomerates of commodity passing through the delumper such that the commodity flows freely through the discharge outlet of the delumper. The blades 46 may be any shape or thickness desired and may depend on the physical properties of the commodity passing through the delumper, for example, rectangular plates one-quarter inch in thickness may be used to for breaking up bisphenol A agglomerates. The blades 46 are mounted on the shaft spaced apart a predetermined distance and preferably at a 90 degree angle, however any desired angle may be used. If desired the plates 46 may be sharpened for better cutting or breaking up of the agglomerates.

Mounted to side walls 22 and 23 are a plurality of stationary blades 47 in a linear fashion and spaced apart a predetermined distance sufficient to alternatingly mesh with the rotatable blades 46. Each rotatable blade 46 rotates between two stationary blades mounted to each side wall 22 and 23. The stationary blades 47 can also be any shape of thickness desired. In this instance, the stationary blades 47 are flat plates trapezoidal in shape. The stationary blades 47 assist in breaking up of agglomerates by providing a means for shearing to take place as the rotating blades 46 strike the agglomerates.

Figure 4:
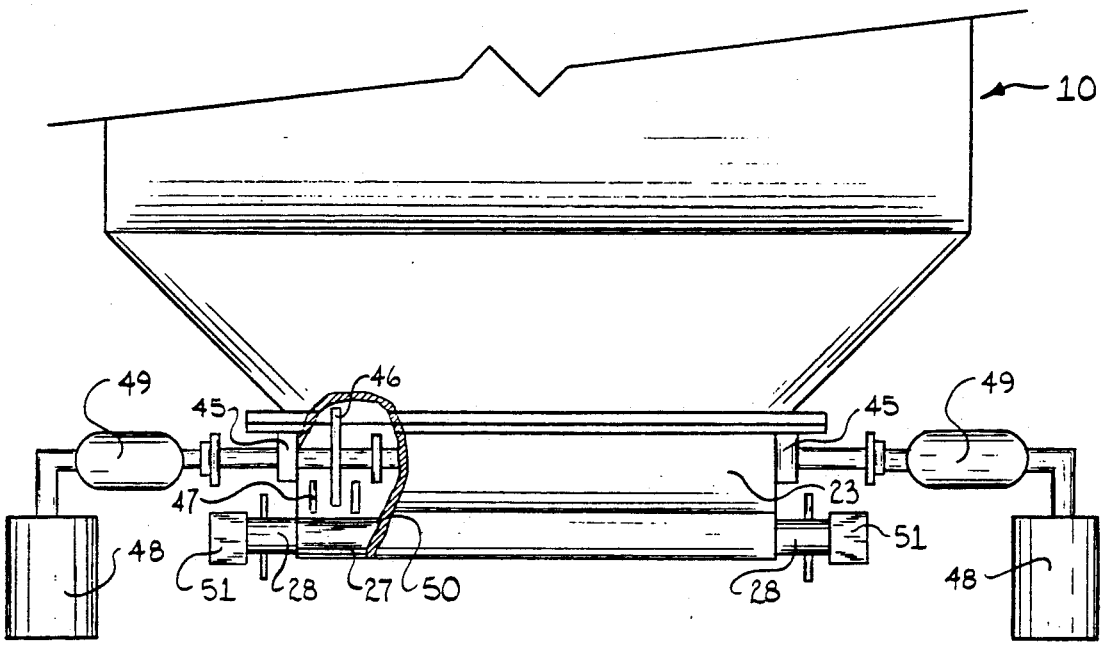
FIG. 4 is a schematic front view, partially broken away, showing the delumper of the present invention.
Figure 5:
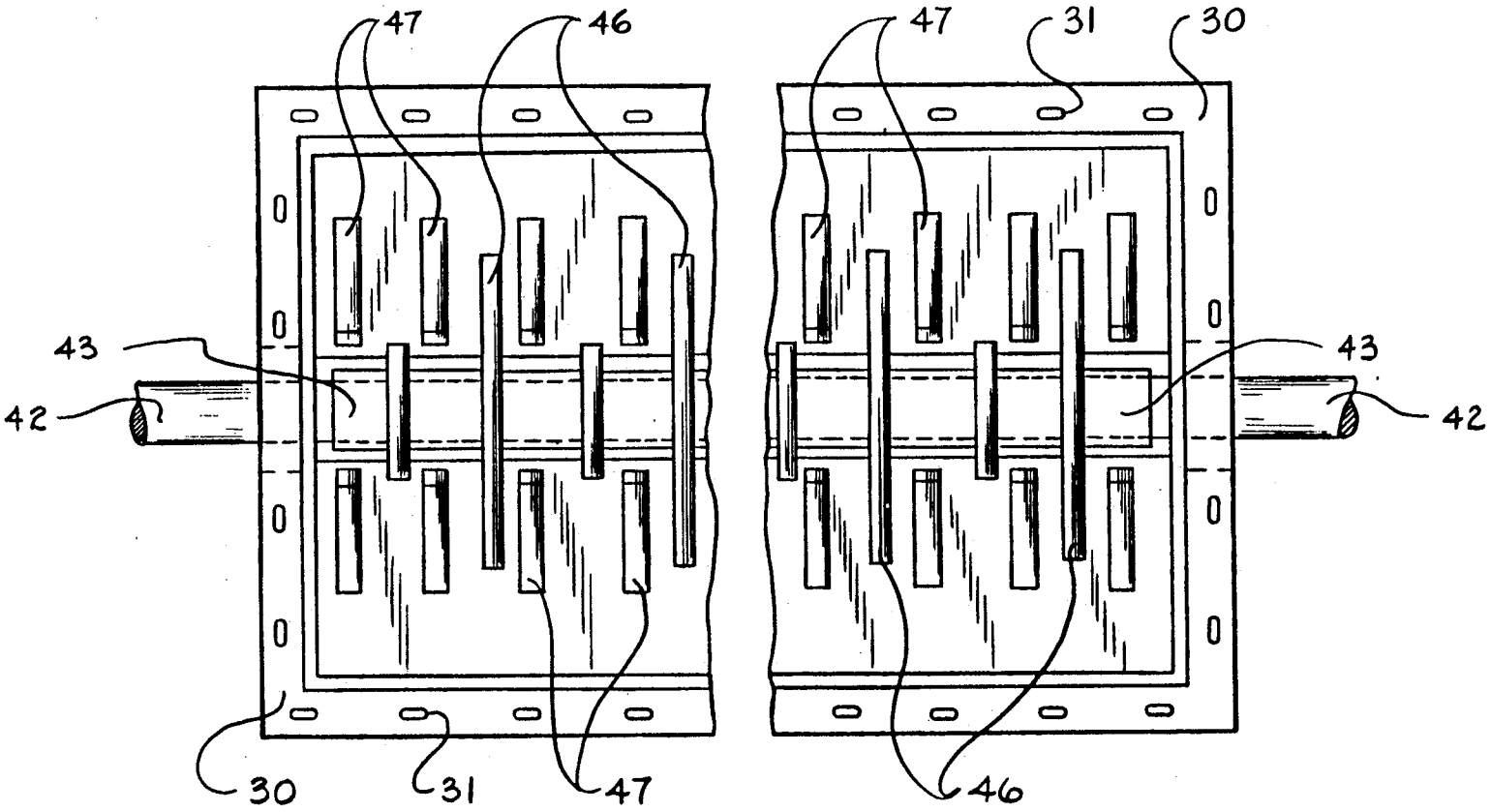
FIG. 5 is a plan view showing the delumper of FIG. 3.

With reference to FIG. 4, an actuating means such as a detachable motor 48 is mounted to the shaft 41 exterior to the housing 21, for rotating the shaft 41 and thus rotating the blades 46. A torque limiter 49 is mounted to the shaft 41 to prevent the motor 48 from burning as is known in the art.

As aforementioned, the discharge arrangement 26 is preferably a hollow generally circular tubular housing 27 attached to the underside of walls 22, 23, 24 and 25. The inside of housing 27 contains tubular member 28 with outlets 29 and a longitudinal slot defining an open ended discharge trough 50 generally with a longitudinal concave surface beneath the rotating shaft 41 and blades 46 and 47. The inside tubular member 28 coaxially aligned with the housing 27 may be turned such that the slotted opening is aligned with the opening of the housing 27 to allow commodity to fall by gravity or pneumatically into the tubular member 28 for pneumatically unloading the commodity. Removable end caps 51 may be used to close the commodity outlets 29 at opposite ends of the trough 50. A source of suction or air pressure may be connected to outlets 29 in conventional manner to facilitate pneumatic unloading of car 10. Other opening means for housing 27 may include a longitudinal spiral member or a perforated member (not shown). Other transport media other than air can be used for carrying the commodity in a slurry form.

To unload a railroad hopper car 10, a pneumatic discharge system is connected to the outlets 29 on the end wall 24 and 25 to pass an air stream through the discharge trough 50 and falling material into the path of the air stream is conveying to its use point. The motor 48 is connected to shaft 41 to rotate the shaft 41 and blades 46. As the blades 46 on the shaft 41 rotate any agglomerates too large to pass to the trough 50 and between the rotating blades 46 and stationary blades 47 are broken up to a size for pneumatically conveying. After a car lading has been discharged using the delumper of the present invention, the shaft rotation is stopped, the motor detached and any auxiliary hoses disconnected.

The delumper/off-loader of the present invention is advantageously used in solids applications for products that are either too large to be pneumatically conveyed such as coal or limestone or other products that form agglomerates. For example, bisphenol is a granular product which forms agglomerates when exposed to moisture.

The foregoing description and drawings explain and illustrate a particular embodiment of the present invention and the invention is not intended to be limited thereto, except by the scope of the appended claims. Those skilled in the art who have the present disclosure before them will be able to make changes and variations therein without departing from the spirit and scope of the invention disclosed herein.

What is claimed is:

1. A railroad hopper car outlet delumping unit for discharging a solid commodity consisting essentially of:

a. a pair of sloping side walls in a generally V-shape configuration aligned normal to the length of the railroad hopper car integral with a pair of vertical end walls;

b. means defining an elongated trough beneath said side walls including a rotatable tubular member having a longitudinal slot and being coaxially aligned within the trough for opening or closing flow of material from said unit;

c. a rotatable shaft generally disposed above said trough rotatably mounted to the end walls;

d. a plurality of stationary delumping blades attached on the surface of said sloping side walls;

e. a plurality of rotatable delumping blades attached to said rotatable shaft, and f. wherein the rotatable delumping blades and stationary delumping blades are alternatingly disposed in said unit, whereby the blades are adapted for breaking apart any agglomerated solid commodity passing to the hopper outlet upon rotation of the rotatable delumping blades;

said rotatable shaft having a torque limiter means and means for detachable connection to a means of rotation.

2. A railroad hopper car comprising an enclosed vessel for a solid commodity and a plurality of hopper outlet delumper units at the bottom of said vessel for discharging said commodity, each of said hopper outlet delumper units consisting essentially of:

a. means defining a pair of sloping side walls in a generally V-shape configuration aligned normal to the length of the railroad hopper car and integral with a pair of vertical end walls that terminate adjacent above a discharge trough;

b. means defining an enclosed elongated trough beneath said side walls including a rotatable tubular member having a longitudinal slot and being coaxially aligned within the trough for opening or closing flow of material from said unit;

c. a rotatable shaft across said trough and attached to said end walls;

d. a plurality of stationary delumping blades attached on the surface of said sloping side walls;

e. a plurality of rotatable delumping blades on said rotatable shaft, wherein the rotatable delumping blades and stationary delumping blades are alternatingly disposed in said unit and whereby the blades, upon rotation of the rotatable delumping blades, break apart any agglomerated solid commodity passing to the hopper outlet;

said rotatable shaft having a torque limiter means and means for detachable connection to a means of rotation.

* * * * *